US008651972B2

(12) United States Patent
Hoeschler et al.

(10) Patent No.: US 8,651,972 B2
(45) Date of Patent: Feb. 18, 2014

(54) ARTIFICIAL SPORT LOG

(76) Inventors: Judith L. Hoeschler, La Crosse, WI (US); Jay F. Hoeschler, La Crosse, WI (US); Abigael A. Hoeschler, La Crosse, WI (US)

( * ) Notice: Subject to any disclaimer, the term of this patent is extended or adjusted under 35 U.S.C. 154(b) by 207 days.

(21) Appl. No.: 13/300,001

(22) Filed: Nov. 18, 2011

(65) Prior Publication Data

US 2013/0130814 A1 May 23, 2013

(51) Int. Cl.
*A63B 4/00* (2006.01)
*A63H 23/10* (2006.01)

(52) U.S. Cl.
USPC ..... 472/127; 472/129; 446/153

(58) Field of Classification Search
USPC ..... 472/13, 127, 128, 129; 446/153, 155, 446/160
See application file for complete search history.

(56) References Cited

U.S. PATENT DOCUMENTS 2,931,648 A * 4/1960 Davies ..... 472/127
3,329,425 A * 7/1967 Gieseler ..... 472/129
3,953,024 A * 4/1976 Brubacher ..... 472/127
4,281,830 A 8/1981 Rehbein
5,009,413 A * 4/1991 Allen ..... 472/128
5,663,210 A 9/1997 Sugimoto et al.
6,220,599 B1 * 4/2001 Eisch ..... 273/457
6,845,952 B2 * 1/2005 Abel et al. ..... 244/165
7,998,031 B2 * 8/2011 Dumke et al. ..... 482/55

* cited by examiner

*Primary Examiner* — Kien Nguyen
(74) *Attorney, Agent, or Firm* — Nikolai & Mersereau, P.A.; C. G. Mersereau

(57) ABSTRACT

A lightweight, portable artificial sport log having physical properties that mimic a selected natural log is disclosed that has a hollow cylindrical shell of a suitable polymeric material defining a volume having the desired dimensions of length and diameter of a selected natural log of interest, an internal baffle support shape of a rigid polymeric foam material is fixed to said internal surface of said cylindrical shell, end closure members at ends of said hollow cylindrical shell provided with sealable fill/discharge openings for adding and draining water from the artificial log. The internal baffle volume and shape are determined such that the buoyancy of the artificial log generally equals the buoyancy of the natural log of interest and the mass moment of inertia resembles that of the natural log of interest when the artificial log is filled with water.

18 Claims, 3 Drawing Sheets

12
10
14
16
18
20
18
16
22
24

16
18
14

ARTIFICIAL SPORT LOG

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to sport log devices such as the type used in logrolling competitions or for fun and, more particularly, to a lightweight, easily portable synthetic sport log that can be manufactured to closely mimic the behavioral physical characteristics of a natural wooden log such as one of the type used for logrolling when the synthetic log is filled with water and floated in water. This includes buoyancy and mass moment of inertia.

II. Related Art

Logrolling has long been well known as a recreational or competitive water sport. The logs used in this sport, including practice logs, are typically about 6-12 feet (1.85-3.7 m) long and 12-18 inches (38.1-45.7 cm) in diameter and are made of a wood, typically western red cedar, weighing upwards of 340 pounds (154 kg). The disadvantages associated with the use of natural logs, including size, weight and interactions with water, and export/import restrictions have made repeated transporting and deployment of natural logs difficult. This has led to attempts to make artificial logs that do not pick up fungi, etc. and are easier to transport and deploy. However, these artificial logs have met with only a minor degree of success to date due to deficiencies in the behavioral physical characteristics of the artificial logs when compared to their natural counterparts.

One design of an artificial log is found in U.S. Pat. No. 4,281,830, which discloses a manufactured log that includes a pair of conjoined, substantially identical, opposed hollow longitudinal cylindrical half sections designed to be filled with water and that may contain circumferential baffles and/or inwardly directed longitudinal flanges attached to the half sections designed to control a log behavior. While that design has met with some success, such a design has still fallen short of displaying the characteristics of a comparable natural log.

SUMMARY OF THE INVENTION

By means of the present invention, there is provided an lightweight, easily portable artificial sport log suitable for logrolling or other endeavors using a buoyant floating log when it is filled with water. The log has a design that comes very close to mimicking the physical characteristics of a corresponding selected natural log in the water, yet is lightweight and quite portable when empty. The artificial sport log of the invention is designed to be transported and stored empty and filled with water for use. The log design of the invention includes an outer cylindrical shell, preferably of a relatively rigid foamed polymeric material, having end caps and a fixed internal baffle system of a lightweight rigid polymeric foam material which may be in the shape of a symmetrical cross or other shape which, when fixed to the outer shell, defines a plurality of at least three symmetrical similar separate compartments for containing water when the log is in use. The baffle affords additional strength to the shell and if fewer than three are used, the distance between supports becomes too great.

As used herein, the term "polymeric material" is meant to be construed in a broad sense so as to include any composition suitable for the parts of the log. Foamed materials are preferred as they are relatively lightweight. The thickness and density of the baffle in relation to the diameter of the shell determines the relative mass moment of inertia and buoyancy of the artificial log and can be configured to closely match a selected variety of natural log such as western red cedar.

Logs in accordance with the present invention may be of any desired size and the internal baffle configuration is configured so that the water compartments are outside the baffle and is sized to provide the desired buoyancy and mass moment of inertia to mimic a natural log of interest. For use in logrolling the logs of the invention are typically about 12 feet long and 12-18 inches in diameter and weighing from about 50 pounds to about 100 pounds empty. Openings are provided in the shell end caps for filling the artificial log with water for use and draining the log for transport and storage. The fill/discharge openings are provided with removable caps or plugs.

The outer surface of the log may be rough or smooth and a layer of carpeting or synthetic traction material may be added to the central area to increase traction if desired.

BRIEF DESCRIPTION OF THE DRAWINGS

In the drawings wherein like numerals depict like parts throughout the same.

DETAILED DESCRIPTION

The following description details one or more exemplary embodiments illustrating the present invention. It will be appreciated that the detailed descriptions are intended by way of example only and are not intended to limit the scope of the invention in any respect. It will be further understood that the embodiments of the invention can be modified by those skilled in the art while remaining in keeping with the inventive concepts.

Figure 1:
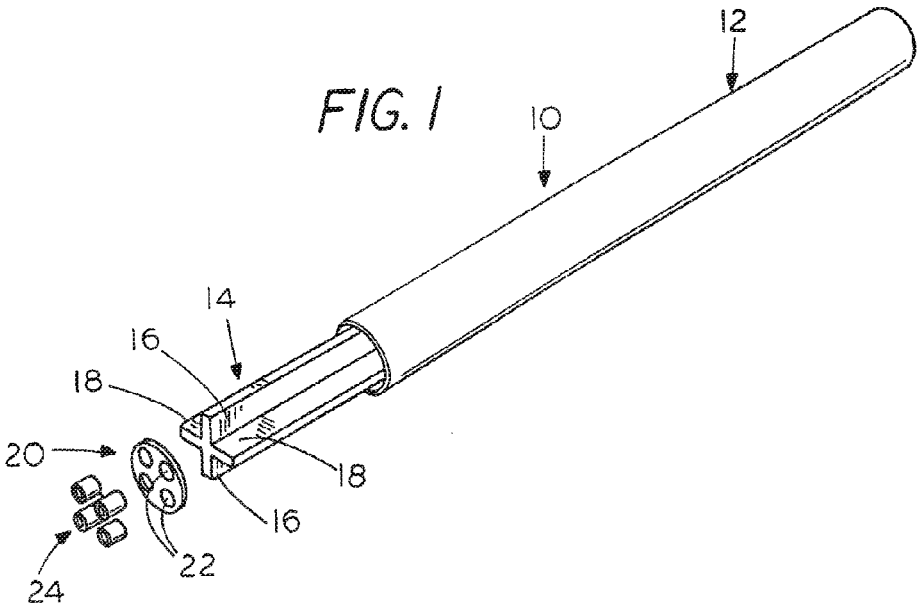
FIG. 1 is an exploded perspective view of an embodiment of a log in accordance with the invention.

FIG. 1 is an exploded perspective view of an embodiment of a log 10 having an outer shell 12. A longitudinal internal baffle 14, shown partially exposed, is in the shape of a cross having vertical arms or members 16 (as shown in the drawing) and horizontal arms or members 18. See also FIG. 2. An end cap is shown at 20 with fill/discharge openings 22 and a set of removable closure caps for the openings at 24. An assembled log is shown in FIG. 3 with the closure caps removed and fill/discharge openings 22 exposed. An optional joint is shown at 26 for assembling the shell from two sections 28 and 30.

The shell may be made from any suitable polymeric material which, with the internal baffle, enables one to stand on the log and manipulate the log. Preferred materials include a polyethylene closed cell foamed composition, for example. A shell for logrolling is typically about 12 feet long and 12-18 inches in diameter and about 0.5 inches thick, depending on the material used. The internal baffle provides additional strength and rigidity of the log and is of a very lightweight rigid foam material which may be, for example, a lightweight polyurethane foam having a density of about 2 lbs. per $ft^3$. These materials give the log its buoyancy and the thickness of the arms or cross members 16 and 18 determines the volume of foam relative to water in a filled log and, thus, the weight of the log relative to water when the remainder of the log is filled with water. The baffle cross members are fixed to the internal surface of the log shell and define four separated internal longitudinal volumes. While other numbers of baffle arms can be used (generally three or more), a cross shape with four members has been found to work very well.

Figure 2:
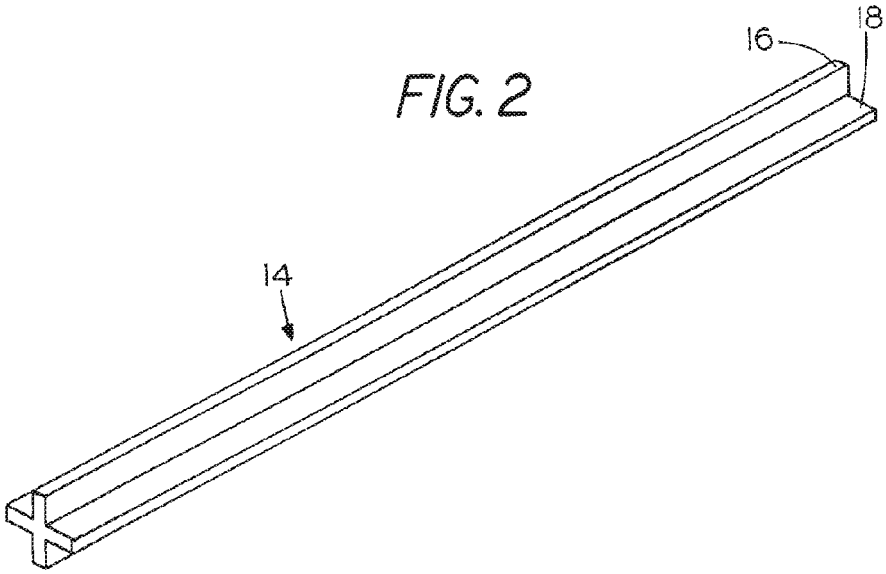
FIG. 2 is a perspective view of the internal baffle of FIG. 1.
Figure 3:
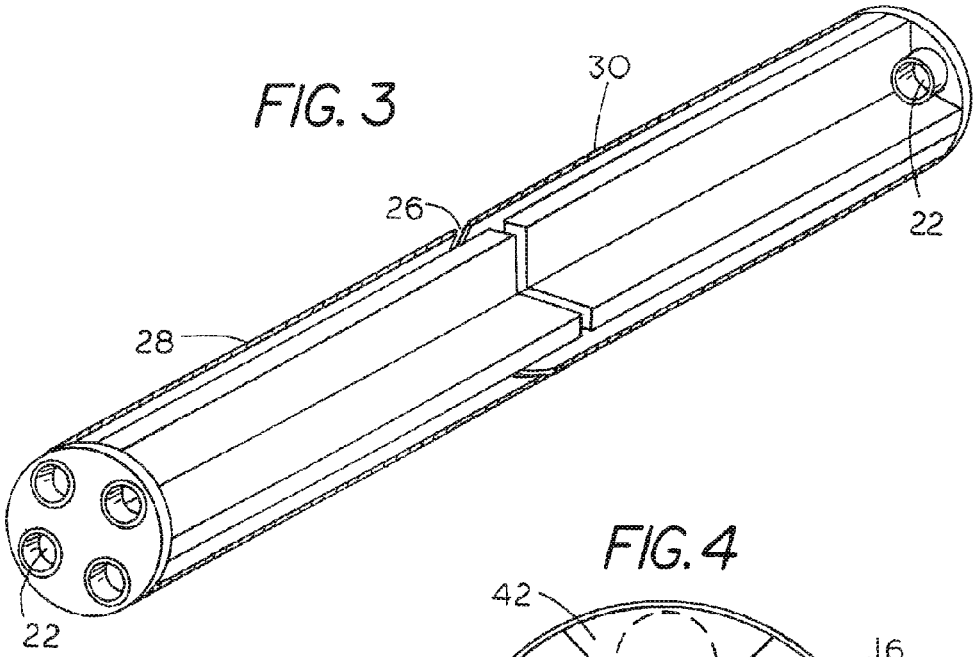
FIG. 3 is a perspective view of an assembled log having two conjoined sections with parts cut away to show fill/drain openings.
Figure 4:
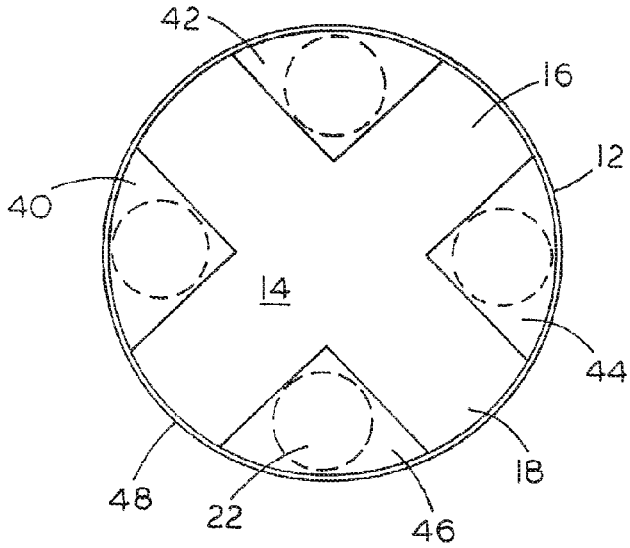
FIG. 4 is an end view of an embodiment of an artificial log in accordance with FIGS. 1-3 shown with the end cap removed.

FIG. 4 is an end view of an artificial log as in FIGS. 1-3 rotated 45° with the end cap removed and showing the relative location of fill/drain ports 22 at a far end of the structure. The drawing defines four outer chambers for containing water at 40, 42, 44 and 46. They are symmetrically located and the configuration of the rigid foam baffle 14 causes the fill water to be contained toward the outside of the structure. The foamed baffle 14 is fixed to the inside surface of the shell 12 in four locations, thereby dividing the internal volume of the shell 12 into four separate symmetrical compartments. Locating the fill water toward the outside of the shell has been found to be quite beneficial with regard to the rotational operation of the log in water.

Figure 5:
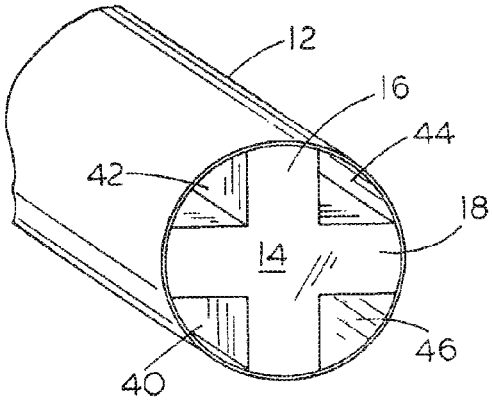
FIG. 5 is a fragmentary perspective view of the embodiment of FIGS. 1-4.

FIG. 5 is a fragmentary perspective view of the shell and baffle arrangement as shown in FIG. 4.

Figure 6:
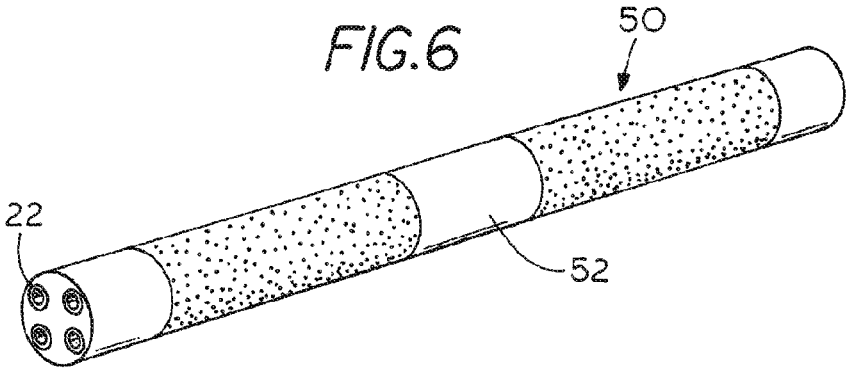
FIG. 6 is a perspective view of a log embodiment in accordance with the invention.
Figure 7:
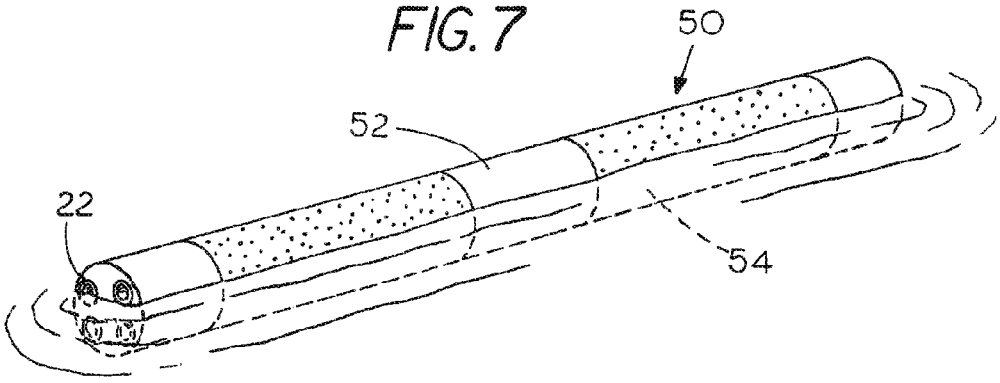
FIG. 7 is a perspective view of the log of FIG. 6 shown filled and floating in water.

FIG. 6 is an embodiment of an artificial log 50 showing a central section of the log which may contain carpet or other material 52 to aid in the stability or traction of the footing of one standing on the log for logrolling. FIG. 7 shows the log of FIG. 6 with the compartments filled with water and floating in water 54.

The relative thickness of the baffle cross members can be sized so that the buoyancy of the filled artificial log equals that of a natural log of a desired wood. If it be assumed that both logs are totally submerged in fresh water, a 16" diameter (40.64 cm)×12' (3.66 m) western red cedar log having a density $\rho$=25 lbs/$ft^3$ has a net buoyancy of 435 lbs. An equivalent 16"×12' artificial log in accordance with the invention using a foam baffle having a density of 2 lbs/$ft^3$ requires an internal baffle just fitting inside the log having a volume of 7.2 $ft^3$. This yields a buoyancy of 7.2 (62.4−2)=434.9 lbs or ~435 lbs. This assumes that the four compartments defined by the baffle are filled with water and so afford no additional buoyancy. Other sizes of logs can be produced to equal a corresponding natural log of comparable size.

In addition to duplicating the buoyancy of a natural log, artificial logs fabricated in accordance with the present invention have been found also to possess a mass moment of inertia that mimics that of a comparable natural log so that the artificial log not only has comparable buoyancy but also has comparable rotational characteristics in water.

As previously indicated, the lightweight, rigid foam baffle utilized in the structure of the artificial log of the present invention is not only instrumental in determining the buoyancy and mass moment of inertia of the artificial log, it serves to provide structural support inside the shell of the log which enables the outer shell of the log to be of a lesser thickness. Thus, the closed cell at least partially foamed outer shell combines with the rigid foamed inner baffle to provide a lightweight but very strong log structure in which inner support members are symmetrically placed and support is afforded as the log rotates. It should further be noted that while the internal baffle structure shown in the detailed description is in the shape of a cross containing four arms, other shapes which can attach to the inner surface of the log shell and can divide the volume into a plurality of succinct compartments between the baffle and the shell could also be used successfully. Accordingly, it is anticipated that any symmetrical internal baffle shape having three or more arms could be used. Of course, in order to successfully divide the volume into succinct and separate compartments, the baffle must run the entire length of the shell and be fixed to the shell.

As shown in FIG. 3, it is anticipated that the artificial log of the present invention could be fabricated in two or more sections which could thereafter be joined to form the entire length of the log and a log of any desired dimensions of diameter and length. A distinct advantage of the log of the present invention lies in the fact that when the log is empty, it is very lightweight and easily transported from place to place, unlike heavy natural logs. Thus, a log 15 inches in outside diameter by 12 feet long may weigh less than 100 pounds and, depending on the actual materials used, may even weigh less than 50 pounds. The cylindrical shell of the artificial sport log of the invention is preferably formed using a rotational molding technique.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. An artificial sport log comprising:

(a) a hollow cylindrical shell of a suitable polymeric material having an external and an internal surface and defining a volume and having desired dimensions of length and diameter of a log of interest;

(b) an internal baffle of a polymeric material in the form of lightweight rigid foam shape that divides the internal volume into a plurality of three or more compartments, said baffle being fixed to said internal surface of said cylindrical shell; and (c) end closure members at ends of said hollow cylindrical shell, said log being provided with fill/discharge openings for adding and draining water from each compartment of said artificial log, said fill/discharge openings being further provided with removable closure caps.

2. An artificial sport log as in claim 1 wherein said artificial log is constructed with physical properties that optimally mimic physical properties of a natural log of a selected known tree species and wherein the relative volume of the internal baffle is determined such that the buoyancy of said artificial log generally equals the buoyancy of a log of said selected known tree species when the artificial log is filled with water.

3. An artificial sport log as in claim 2 wherein the internal baffle is shaped such that the mass moment of inertia resembles that of a log of said selected known tree species.

4. An artificial sport log as in claim 3 wherein said internal baffle has a cross section in the shape of a cross and divides the internal volume of the hollow cylindrical shell into four compartments extending the length of said log.

5. An artificial sport log as in claim 4 wherein said hollow cylindrical shell is fabricated from a polymeric material comprising a foamed polyethylene and said internal baffle is fabricated from a rigid foam comprising polyurethane.

6. An artificial sport log as in claim 3 wherein said hollow cylindrical shell is fabricated from a polymeric material comprising a polyethylene and said internal baffle is fabricated from a rigid foam comprising polyurethane.

7. An artificial sport log as in claim 1 wherein said internal baffle has a cross section in a shape that divides the internal volume of the hollow cylindrical shell into at least four compartments extending the length of said log.

8. An artificial sport log as in claim 1 wherein said hollow cylindrical shell is fabricated from a polymeric material.

9. An artificial log as in claim 8 wherein said polymeric material includes polyethylene.

10. An artificial sport log as in claim 9 wherein said internal baffle is fabricated from a polyurethane foam.

11. An artificial sport log as in claim 1 wherein a fill/discharge opening addresses an end region of said compartments.

12. An artificial sport log as in claim 1 wherein said log of interest is a western red cedar log.

13. An artificial sport log as in claim 1 wherein said hollow cylindrical shell is a continuous member.

14. An artificial sport log as in claim 1 wherein said log comprises a plurality of joined sections.

15. A method of fabricating an artificial sport log comprising:

(a) fabricating a hollow cylindrical shell of a suitable polymer material having an internal and an external surface and defining a volume of the desired dimensions of a selected natural sport log of interest (b) fixing an internal baffle shape of a rigid lightweight polymeric foam material in said shell said baffle dividing said volume into a plurality of outer compartments extending the length of said cylindrical shell; and (c) attaching end closure members to said cylindrical shell and fill/discharge openings corresponding to the end regions of said compartments and having removable closure caps.

16. A method as in claim 15 wherein said shell is a continuous member formed using a rotational molding technique.

17. A method as in claim 16 wherein said shell is fabricated from polyethylene.

18. A method as in claim 15 wherein said log is fabricated as a plurality of sections and comprising the further step of joining said plurality of sections.

* * * * *